US012303012B2

(12) United States Patent
Sze

(10) Patent No.: US 12,303,012 B2
(45) Date of Patent: May 20, 2025

(54) HAIR FASTENERS

(71) Applicant: Tung Hing Plastic Manufactory Ltd., Hong Kong (HK)

(72) Inventor: Ka Chuen Sze, Hong Kong (HK)

(73) Assignee: Tung Hing Plastic Manufactory Limited, Hong Kong (HK)

( * ) Notice: Subject to any disclaimer, the term of this patent is extended or adjusted under 35 U.S.C. 154(b) by 176 days.

(21) Appl. No.: 17/806,715

(22) Filed: Jun. 13, 2022

(65) Prior Publication Data

US 2023/0397704 A1 Dec. 14, 2023

(51) Int. Cl.
*A45D 8/30* (2006.01)

(52) U.S. Cl.
CPC ..... *A45D 8/30* (2013.01)

(58) Field of Classification Search
CPC ..... Y10T 24/44572; Y10T 24/44538; Y10T 24/4447; D06F 55/02; A45D 8/30; A45D 8/28; A45D 8/24; A45D 8/22; A45D 8/20; A44B 9/18
See application file for complete search history.

(56) References Cited

U.S. PATENT DOCUMENTS 3,604,071 A * 9/1971 Reimels ..... A61B 17/30 24/543
3,665,563 A * 5/1972 Batts ..... A44B 99/00 24/543
3,698,043 A * 10/1972 Batts ..... A47G 25/483 223/91
3,896,527 A * 7/1975 Miller ..... A61M 25/02 24/DIG. 22
4,762,296 A * 8/1988 Kraus ..... F16L 3/13 248/74.2
4,835,824 A * 6/1989 Durham ..... F16L 3/12 24/339
6,922,687 B2 * 7/2005 Vernon ..... G06Q 10/08 707/999.001
2008/0156341 A1 * 7/2008 Longoria ..... A45D 8/20 132/277
2009/0090379 A1 * 4/2009 Potut ..... A45D 8/22 132/277
2011/0210215 A1 * 9/2011 Nitsche ..... F16L 3/24 248/74.1
2016/0052689 A1 * 2/2016 Mohika ..... B65D 67/02 24/132 WL
2017/0184140 A1 * 6/2017 Giannatti ..... B60P 7/0876

* cited by examiner

*Primary Examiner* — Nicholas D Lucchesi
*Assistant Examiner* — Jennifer Gill
(74) *Attorney, Agent, or Firm* — Melvin Li

(57) ABSTRACT

The present invention is concerned with a hair fastener. The hair fastener has a first hair claw member and a second hair claw member for accommodating and securing a log of hair therebetween, a first hinge positioned between and pivotably connecting respective rear ends of the first and second claw members together for controlling relative movement thereof, a first handle connected to a rear end of the first claw member, and a second handle pivotably connected to a rear end of the second claw member, and a lock including a first projection extending from the first handle and a second projection extending from the second handle in that the first and second projections are pointed towards, engageable with and lockable against each other.

20 Claims, 10 Drawing Sheets

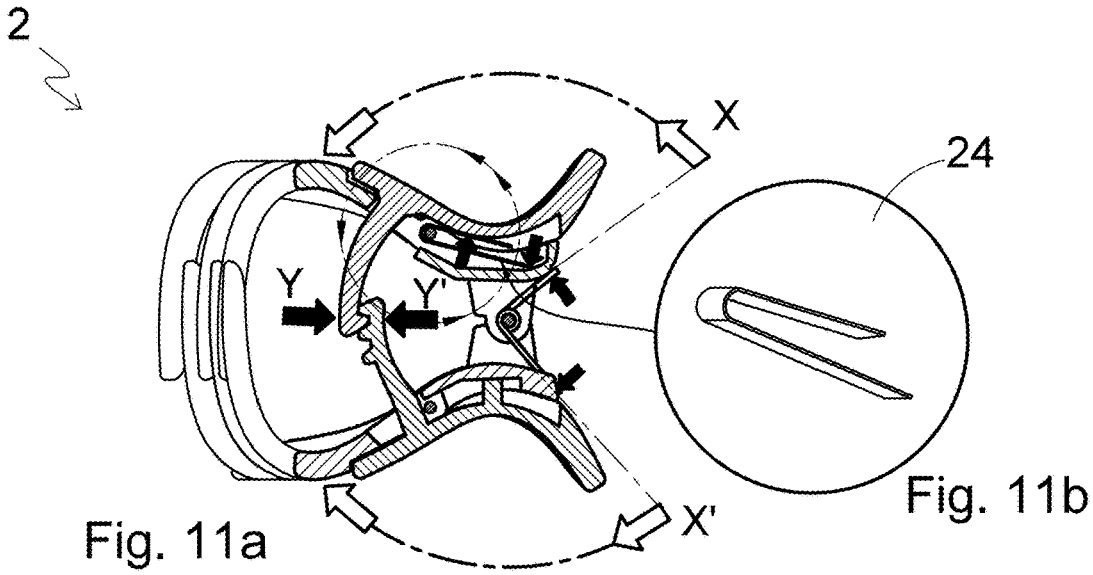
Fig. 11a
Fig. 11b
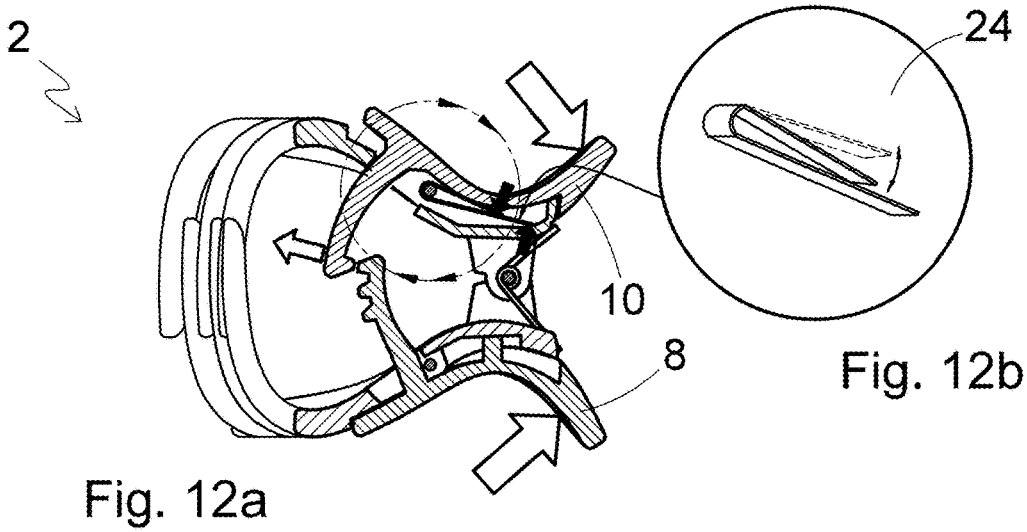
Fig. 12a
Fig. 12b
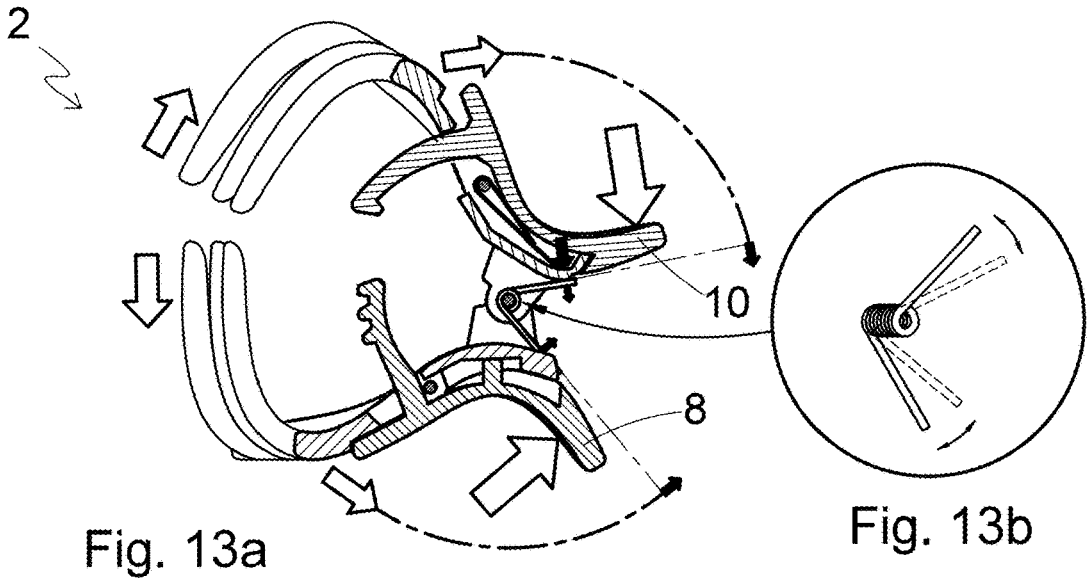
Fig. 13a
Fig. 13b

HAIR FASTENERS

TECHNICAL FIELD

The present invention is concerned with a hair fastener such a hair claw for managing hair and a method of manufacture thereof.

BACKGROUND

There are a wide variety of devices for managing hair.

These devices include, for example, hair clips, barrettes, hair ties and hair claws. These different devices are structured differently and they function to address different needs of a user. For instance, a hair claw tends to be able to handle a larger lock of hair while a barrette tends to secure a thinner layer of hair.

Despite the different types of hair managing device in the market, one problem a user often encounters is that hair fastened inevitably would move slightly when secured by the hair managing device. Repeated movement of the hair relative to the hair managing device would cause the managing device to become loosen from the fastened hair. When such a scenario arises, the user would need to frustratingly remove the hair managing device and re-fasten the hair from time to time.

The present invention seeks to address the aforementioned problem, or at least to provide a useful alternative to the public.

SUMMARY OF THE INVENTION

According to a first aspect of the present invention, there is provided a hair fastener comprising a first hair claw member and a second hair claw member for accommodating and securing a lock of hair therebetween, a first hinge positioned between and pivotably connecting together respective rear ends of the first and second claw members for controlling relative movement thereof, a first handle connected to a rear end of the first claw member, and a second handle pivotably connected to a rear end of the second claw member, a lock including a first projection extending from the first handle and a second projection extending from the second handle in that the first and second projections are pointed towards and engageable with each other, the first projection defining a plurality of recesses along its length and the second projection defining a protrusion for engaging in one of the recesses, wherein the hair fastener is adapted to assume a first configuration in which the protrusion is engaged and locked in one of the recesses whereby fastened hair positioned between the first and second hair claw members does not move or expand the first and second claw members relative to each other, or a second configuration in which the protrusion, on depression of the second handle relative to the first handle, is disengaged from said one of the recesses of the first projection whereby the first and second claw members are movable away from each other thus releasing hair positioned therebetween or a third configuration, and the extent to which the first and second claw members are positioned and maintained with respect to each other is dependent on the particular recess at which the protrusion engages and locks in.

Preferably, each of the first and second claw members may be provided with a plurality of fingers, and wherein, in the first configuration, the fingers of the first claw member and the fingers of the second claw members are arranged complementarily to each other or in an interlocking manner.

Suitably, the first hinge may include a torsional spring defining a first axis about which the first and second claw members move relative to each other and for biasing the first and second claw members towards each other.

Advantageously, the first handle may be fixedly and immovably connected to a rear end of the first claw member, or the first handle and the first claw member may be integrally formed.

In an embodiment, the hair fastener may further comprise a second hinge for controlling pivotable movement of the second claw member and the second handle, wherein the second hinge may define a second axis about which the second claw member and the second handle relative to each other. The second hinge may include a leaf spring positioned in a cavity defined between the rear end of the second claw member and the second handle, and the second handle and the second claw member may be sized and shaped to provide the cavity. In the first configuration, the protrusion may be biased by the leaf spring to engage and lock in said one of the recesses. In the second configuration, initial depression of the second claw member may actuate the second projection and thus may move the protrusion about the second axis and away from said one of the recesses against a biasing force from the leaf spring, and subsequent depression of the second handle may move the second claw member away from the first claw member about the first axis.

In one embodiment, A hair fastener as claimed in claim 1, the first projection may be in the form of two legs arranged in parallel to each other and has a gap therebetween acting as a guide, the two legs may be provided with a plurality of teeth along their length and the plurality of recesses are defined between the plurality of teeth, the second protection may be in the form of a tongue provided with the protrusion at its distal end thereof, and/or the second projection may be provided with a further peg receivable in the guide for aligning the second claw member with the first claw member.

According to a second aspect of the present invention, there is provided a hair fastener comprising a first hair claw member and a second hair claw member for accommodating and securing a lock of hair therebetween, a first hinge positioned between and pivotably connecting together respective rear ends of the first and second claw members for controlling relative movement thereof, a first handle connected to a rear end of the first claw member, a second handle, a second hinge pivotably connecting the second handle to the rear end of the second claw member, a lock including a first projection extending from the first handle and a second projection extending from the second handle in that the first and second projections are pointed towards and engageable with each other, the first projection defining a plurality of recesses along its length and the second projection defining a protrusion for engaging in one of the recesses, wherein the hair fastener is adapted to assume a first configuration in which the second hinge biases the protrusion axially towards one of the recesses, whereby the protrusion is engaged and locked in said one of the recesses and fastened hair positioned between the first and second hair claw members do not move the first and second claw members relative to each other.

Preferably, the hair fastener may be adapted to assume a second configuration in which the protrusion of the second projection, on depression of the second handle relative to the first handle, may, against a biasing force from the second hinge, disengage from said one of the recesses of the first projection, whereby the first and second claw members may be movable away from each other thus releasing hair positioned there between.

Suitably, each of the first and second claw members may be provided with a plurality of fingers, and wherein, in the first configuration, the fingers of the first claw member and the fingers of the second claw members may be arranged complementarily to each other or in an interlocking manner. The first hinge may include a torsional spring defining a first axis about which the first and second claw members may move relative to each other and for biasing the first and second claw members towards each other.

Advantageously, the first handle may be fixedly and immovably connected to a rear end of the first claw member or the first handle and the first claw member may be integrally formed.

In an embodiment, the second hinge may define a second axis about which the second claw member and the second handle move relative to each other, and the second hinge includes a leaf spring positioned in a cavity between the rear end of the second claw member and the second handle.

In one embodiment, in the first configuration, the protrusion may be biased by the leaf spring to engage and lock in said one of the recesses.

In the second configuration, initial depression of the second handle may actuate the second projection and thus the protrusion about the second axis and away from said one of the recesses thus unlocking the first and second claw members from each other, and subsequent depression of the second handle may move the second claw member away from the first claw member about the first axis.

In a specific embodiment, the first projection may be in the form of two legs arranged in parallel to each other and has a gap between the two legs acting as a guide, the two legs may be provided with a plurality of teeth and the plurality of recesses are defined between the plurality of teeth, the second protection may be in the form of a tongue provided with the protrusion at its distal end thereof, and/or the second projection may be provided with a peg receivable in the guide for aligning the second claw member with the first claw member.

According to a third aspect of the present invention, there is provided a hair fastener comprising a first hair claw member and a second hair claw member for accommodating and securing a lock of hair therebetween, a first hinge positioned between and pivotably connecting respective rear ends of the first and second claw members together for controlling relative movement thereof, a first handle connected to a rear end of the first claw member, and a second handle pivotably connected to a rear end of the second claw member, and a lock including a first projection extending from the first handle and a second projection extending from the second handle in that the first and second projections are pointed towards, engageable with and lockable against each other.

Preferably, the first projection may define a plurality of recesses along its length and the second projection may define a protrusion for engaging in one of the recesses, wherein the extent to which the first and second claw members may be positioned and maintained may be dependent on the particular recess at which the protrusion engages and locks in.

BRIEF DESCRIPTION OF THE DRAWINGS

Some embodiments of the present invention will now be explained, with reference to the accompanied drawings, in which:

FIGS. 11*a*-11*b*, 12*a*-12*b*, 13*a*-13*b* are schematic diagrams showing, in one scenario, the operation of the hair fastener of FIG. 1, FIGS. 14*a* and 14*b* are schematic diagrams showing a pair of handles of the hair fastener of FIG. 1;

DETAILED DESCRIPTION OF THE INVENTION

The present invention is concerned with a hair fastener, and is illustrated and explained by way of examples below.

Figure 1:
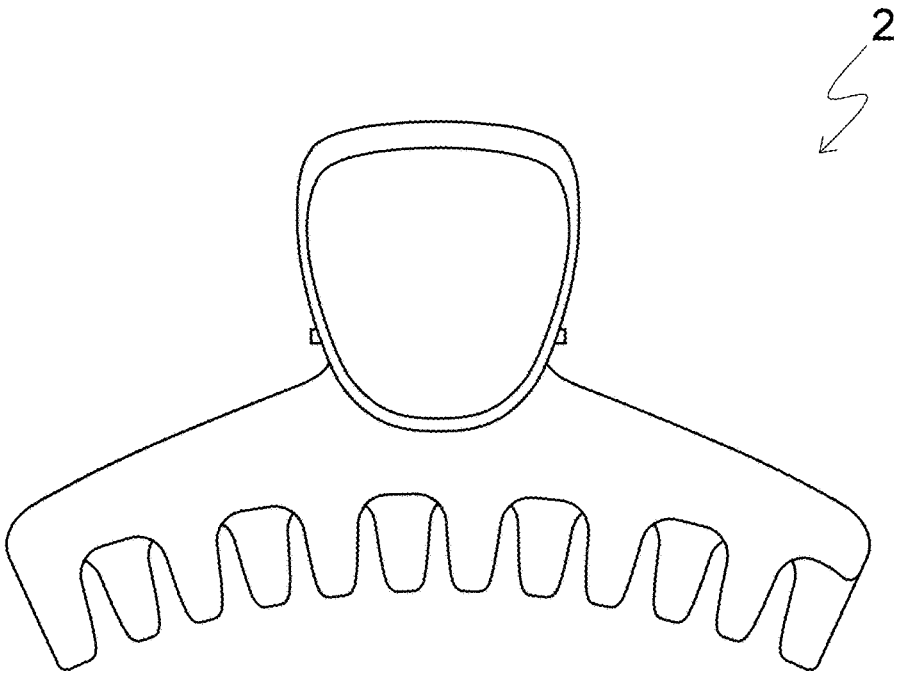
FIGS. 1 and 4 are top view and bottom view of an embodiment of a hair fastener according to the present invention.
Figure 2:
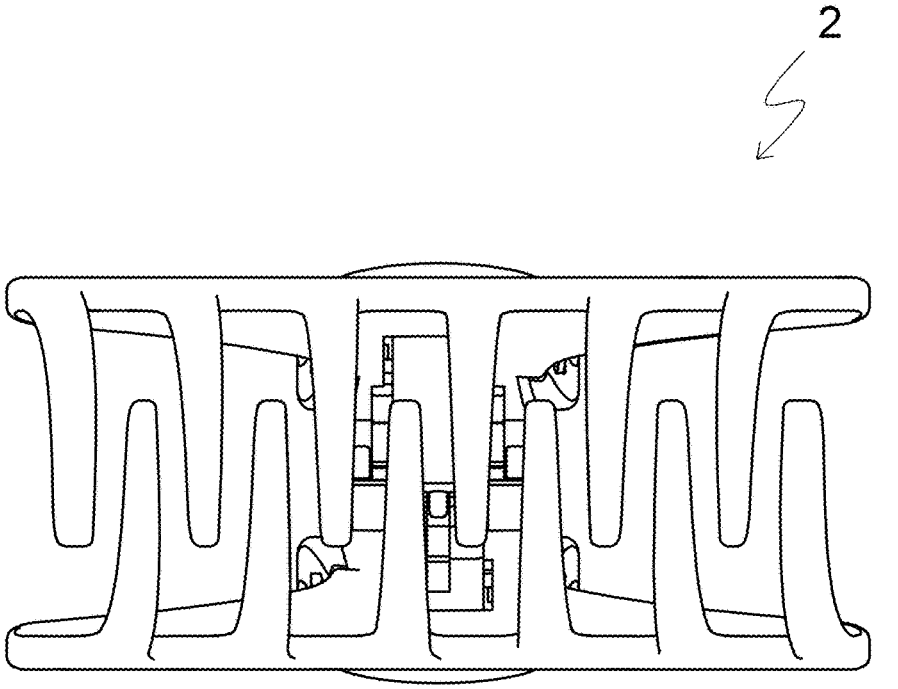
FIGS. 2 and 3 are front view and rear views of the hair fastener of FIG. 1, respectively.
Figure 3:
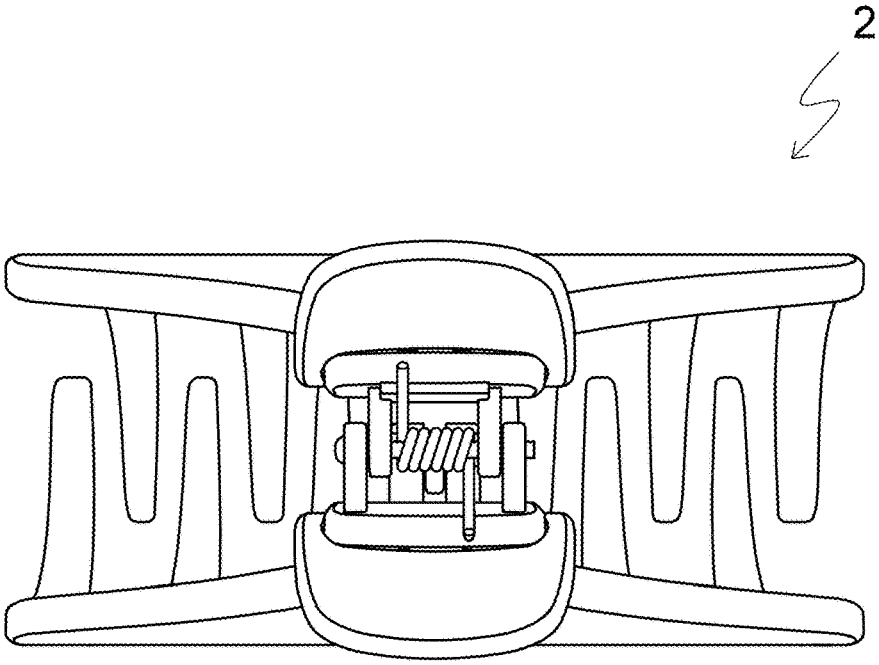
Figure 4:
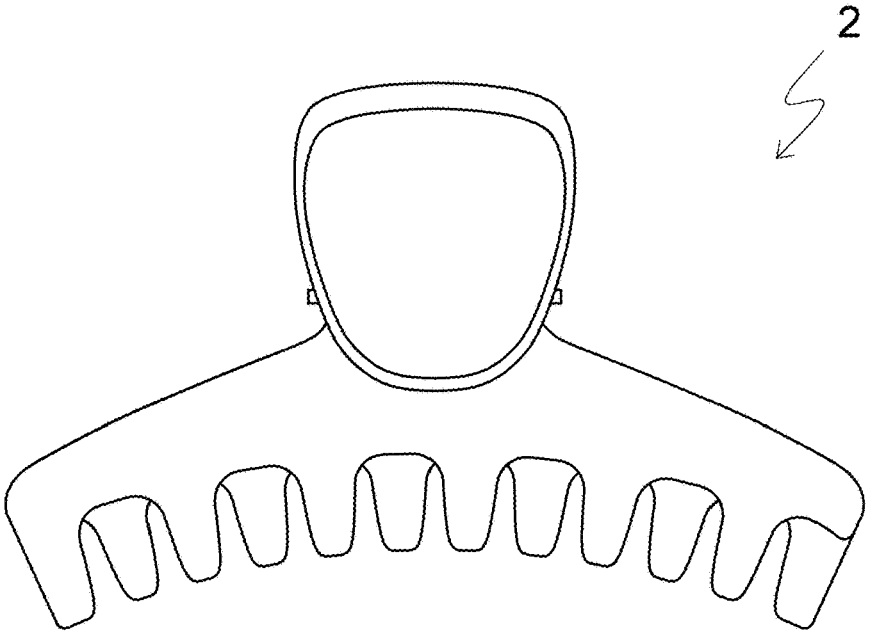
Figure 5:
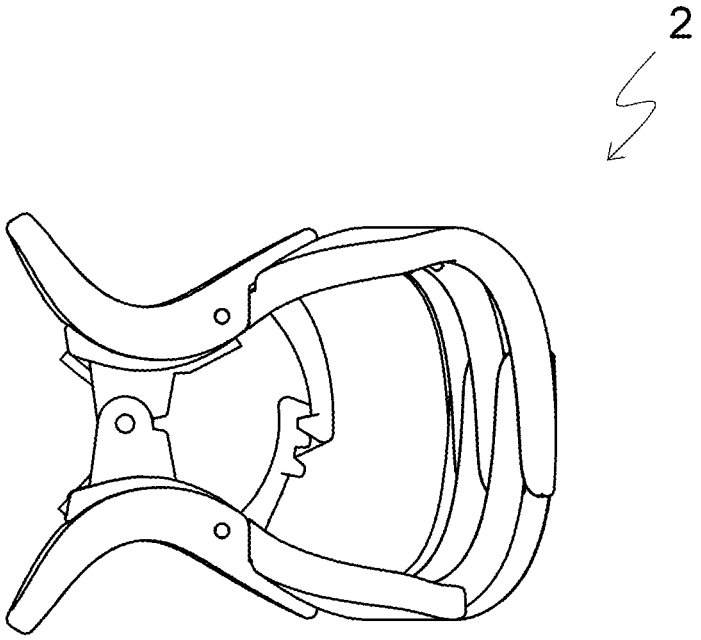
FIGS. 5 and 6 are left side view and right-side view of the hair fastener of FIG. 1.
Figure 6:
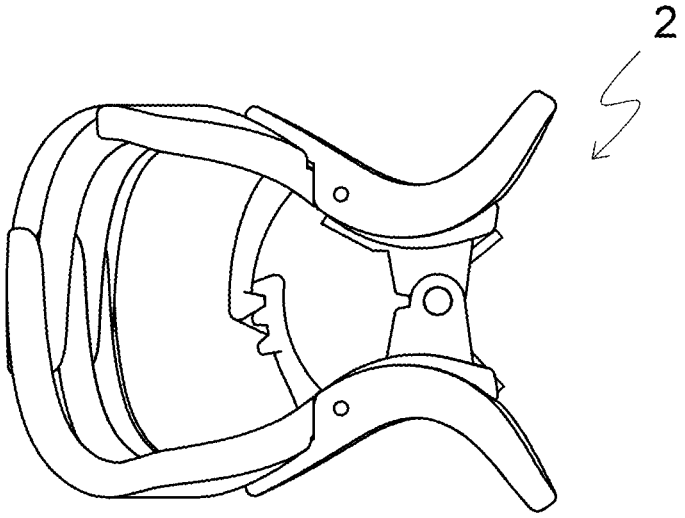
Figure 7:
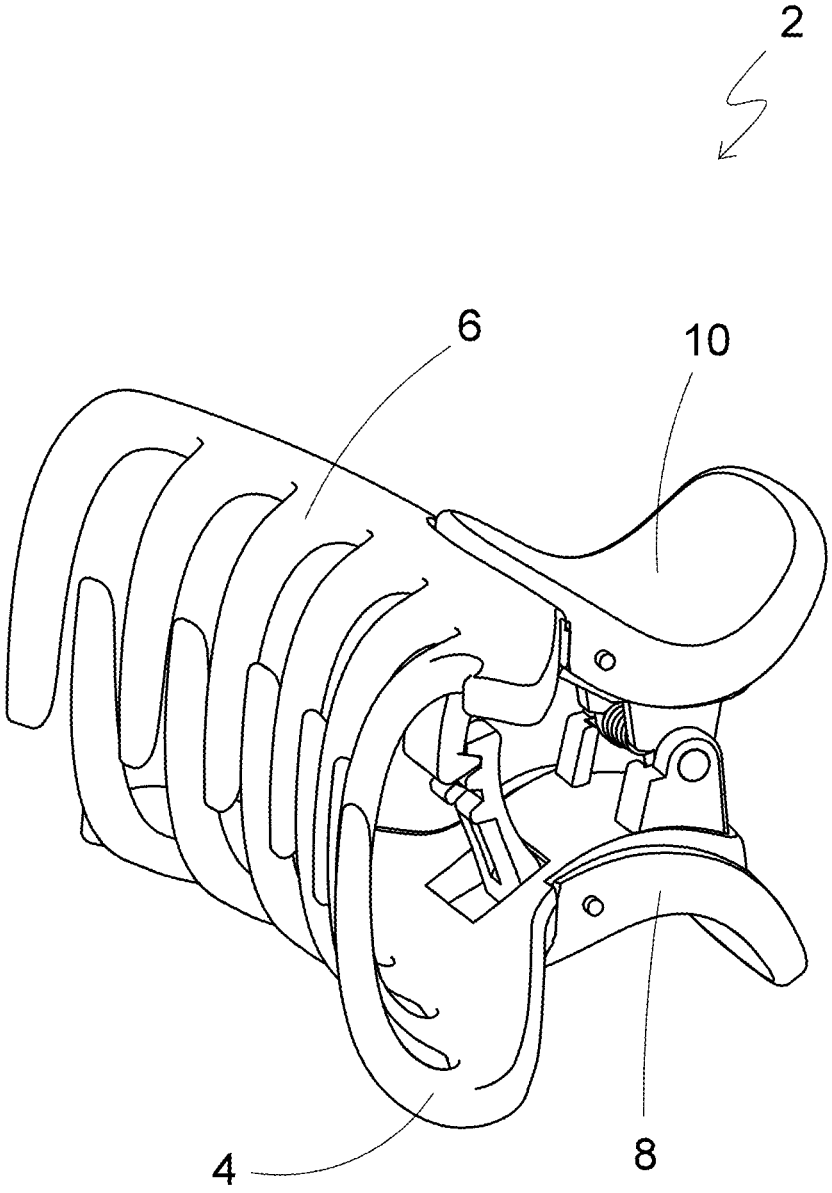
FIG. 7 is a perspective view of the hair fastener of FIG. 1.
Figure 8:
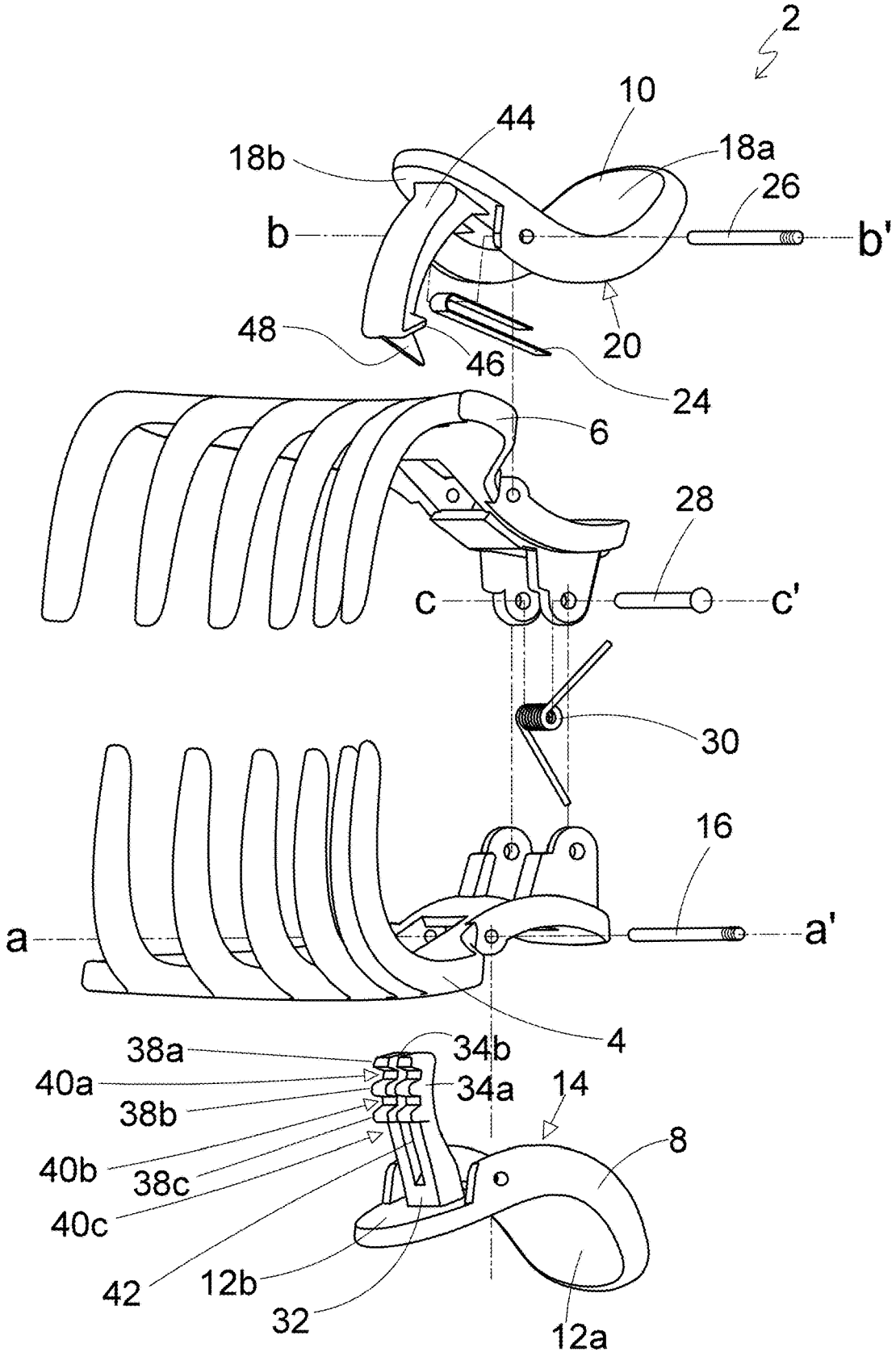
FIG. 8 is an exploded view of the hair fastener of FIG. 1.

A first embodiment of a hair fastener is shown in FIGS. 1-8. In this embodiment, the hair fastener 2 is in the form of a hair claw. FIGS. 7-8, for example, shows that the hair fastener 2 has a first claw member 4 and a second claw member 6, and a first handle 8 and a second handle 10. The first handle 8 defines an outwardly facing surface 12*a* and an inwardly facing surface 12*b*. The first handle 8 is provided with a bay 14 at the inwardly facing surface 12*b* at which a rear portion of the first claw member 4 engages and to which the first claw member 4 is fixedly connected by a pin 16 defining an axis a-a'. In this embodiment, the rear portion of the first claw member 4 is sized and shaped such that when seated in the bay 14, the rear portion generally fully engages with the bay 14 and the first claw member 4 and the first handle 8 are immovably coupled together such that movement of the first handle 8 causes simultaneous movement of the first claw member 4. Despite the presence of the pin 16 and the axis a-a', the first handle 8 and the first claw member 4 are not pivotably movable with respect to each other. In an alternative embodiment, the first claw member and the first handle may be integrally formed.

The second handle 10 also defines an outwardly facing surface 18*a* and an inwardly facing surface 18*b*. The second handle 10 is provided with a bay 20 at the inwardly facing surface 18*b* at which a rear portion of the second claw member 6 engages and to which the second claw member 6 is connected. However, the second handle member 10 and the second claw member 6 are different from the first handle 8 and the first claw member 4 in a number of ways. First, the inwardly facing surface 18*b* of the second handle 10 at the bay 20 has a more convex curvature such that when the rear end of the second claw member 6 engages with the bay 20, there remains a cavity 22 between the rear portion and the bay 20. Second, the hair fastener 2 is provided with a leaf spring 24 in the bay 20 between the second handle 10 and the rear portion of the second claw member 6. Third, while the second handle 10 and the second claw member 6 are also connected by a pin 26, due the presence of the cavity 22 and the leaf spring 24, the second handle 10 is pivotably movable with respect to the second claw member 6 about the axis b-b' defined by the pin 26. Please see for example FIGS. 8 and 9*b*.

The first handle 8 and the second handle 10 are hingedly and pivotably connected together by a pin 28 defining an axis c-c'. The first handle 8 and the second handle 10 are further provided by a torsional spring 30 at the pin 28 for biasing the first handle 8 and the second handle 10, and thus the first claw member 4 and the second claw member 6, together, for securing a lock of hair therebetween. Please see for example 8 and 9*b*.

The hair fastener 2 is further provided with a locking mechanism. The locking mechanism includes a first projection 32 extending transversely from the inwardly facing surface 12*b* and a distal end of the first handle 8. In this embodiment, the first projection 32 is the form of two legs 34*a*, 34*b* arranged in parallel and extending from the first handle 8. The legs 34*a*, 34*b* are provided with a number of teeth 38*a*, 38*b*, 38*c* arranged along the length of the first projection 32. The teeth 98*a*, 38*b*, 38 point away from the hinge of the first and second handles claw members 4, 6. In this embodiment, three sets of teeth are 38*a*, 38*b*, 38*c* are provided on the two legs 34*a*, 34*b*, and as such, the three recesses 40*a*, 40*b*, 40*c* are defined by the three sets of teeth 38*a*, 38*b*, 38*c*. Since the first handle 8 and the first claw member 4 are immovably connected together, movement of the first handle 8 causes simultaneous movement of the first claw member 4. A groove 42 in the form of a track is defined between the two legs 34*a*, 34*b*. The groove 42 serves as a guide, details of which are explained further in the below description. Please see for example FIGS. 8, 9*b* and 10.

The locking mechanism also includes a second projection 44 extending transversely from the inwardly facing 18*b* and a distal end of the second handle 10. In this embodiment, the second projection 44 is in the form of a tongue provided with a protrusion 46 at a distal end thereof. The protrusion 46 extends laterally across the tongue 6. The protrusion 46 is sized and shaped to engage in one of the recesses 40, 40*b*, 40*c* such that when engaged the second projection 44 is locked at and against the first projection 32. The second projection 44 is further provided with a peg 48 at a far end thereof and in the middle of the far end. The peg 48 serves as a positioner for insertion into the groove 42 such that when the first and second claw members 4, 6 become closed together, the first and second handles 8, 10 and also the first and second claw members 4, 6 are aligned. Please see for example FIGS. 5, 6, 7 and 10.

FIGS. 6, 7, 9*b* and 10 further illustrate that the first projection 44 and the second projection 32 pointing towards and engageable with each other.

Figure 9A:
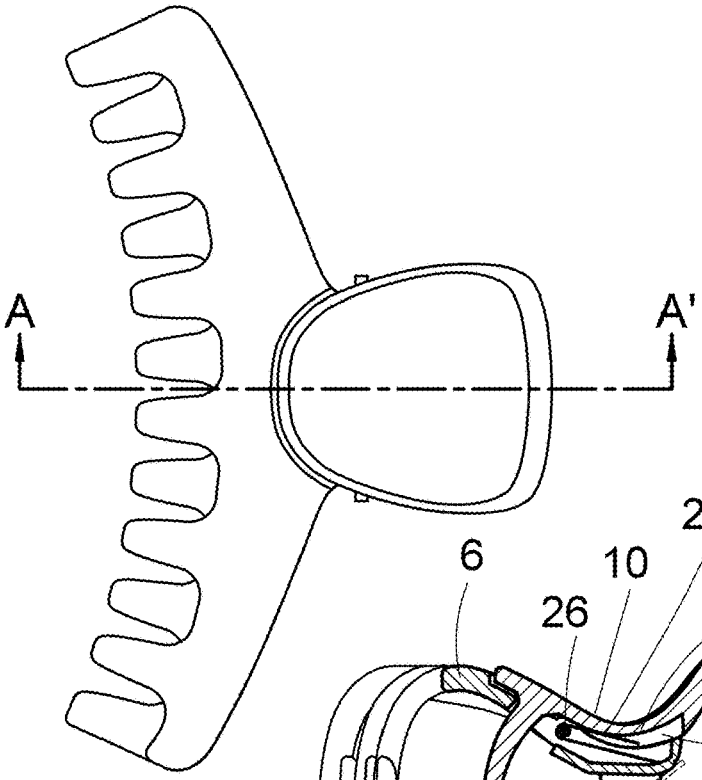
FIG. 9*a* is a top view of the hair fastener of FIG. 1.
Figure 9B:
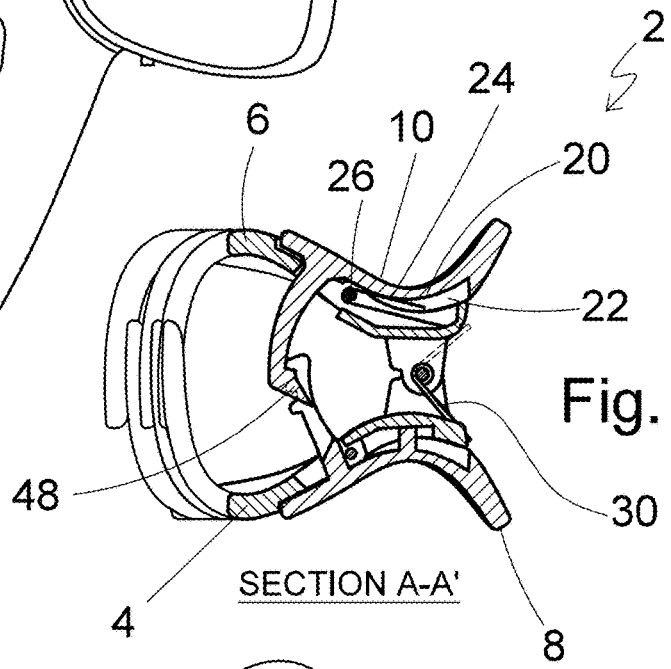
FIG. 9*b* is a schematic diagram showing a sectional view taken at A-A' of FIG. 8*a*.
Figure 10:
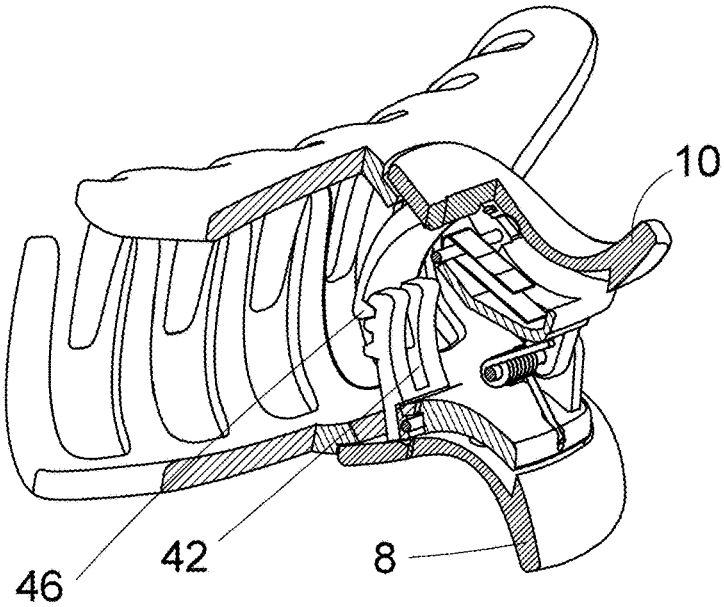
FIG. 10 is a schematic diagram of the hair fastener of FIG. 8 with a portion of the rear removed for showing the construction therein.

FIGS. 9*a*-9*b* and 10 illustrate the hair fastener 2 in a greater detail. FIG. 9*a* is a top view showing the hair fastener 2. FIG. 9*b* is a schematic diagram showing the hair fastener 2. Specifically, FIG. 9*b* is a sectional view taken at line A-A' of FIG. 9*a*. FIG. 9*b* shows the presence of the torsion spring 20 at the hinge connecting the first and second claw members 4, 6. The spring 30 has two wires extended from its respective ends, and the ends of the two wires abuts proximal ends of the first and second claw members 4, 6, respectively. It is to be understood that the spring 30 biases the distal end of the first and second claw members 4, 6, or fingers from the first and second claw members 4, 6, towards each other to assume a closed configuration. When the first and second claw members 4, 6 are closed, the fingers are arranged complementarily.

FIGS. 9*b* and 10 also explains the locking mechanism. As discussed above, the two legs are provided with recesses 40*a*, 40*b*, 40*c* defined by teeth. In this embodiment, three rows of teeth 38*a*, 38*b*, 38*c* are provided, thus defining three recesses 40*a*, 40*b*, 40*c*. FIG. 10 illustrates that the protrusion 46 from the tongue engages in the first recess 40*a* between the first and second rows of teeth 38*a*, 38*b*. It is to be understood that when the protrusion 46 engages at the first recess 40*a*, any attempt of movement of hair secured between the first and second claw members 4, 6 would not be able to expand the claw members away from each other. In other words, the locking mechanism ensures that fastened hair remains secured between the first and second claw members 4, 6.

FIGS. 11*a*-13*b* further explains the locking mechanism. FIG. 11*a* demonstrates a scenario in which a user has secured hair with the hair fastener 2. FIG. 11*a* shows that when the protrusion 46 engages in the first recess 40*a*, the biasing force from the leaf spring 24 between the second handle 10 and the second claw member 6 biases and locks the tongue towards to first recess 40*a* or axially towards the axis c-c', thus preventing the protrusion 46 from disengaging from the first recess 40*a*. Please see arrows marked X and X' and Y and Y' which explain various basing forces during operation. The biasing force X and X' causes the fingers of the claw members 4, 6 to move towards each other, while the biasing force Y and Y causes the protrusion 46 to engage and stay in the first recess 40*a*. In this configuration, the leaf spring 24, due to its mechanical characteristics, has its two wings spread apart. Please see FIG. 11*b*.

FIG. 12*a* demonstrates another scenario in which a user is unlocking the hair fastener 2 from fastened hair. The user begins by gently and slowly squeezes the proximal end of the two handles 8, 10. This action firstly causes the second handle 10 to pivotably move with respect to the second claw member 6 against the biasing action of the leaf spring 24. Please also see the leaf spring in FIG. 12*b*. This action also moves the protrusion 46 away from the first recess 40*a* and axially away from the hinge or the torsional spring 30, thus disengaging the first and second projections 32, 48 from each other and allowing the first claw member 4 and the second claw member 6 to pivotably move with respect to the each other, the degree of movement depends on the extent the user squeezes on the handles 8, 10. FIG. 13*a* illustrates that when rear ends of the handles 8, 10 are further squeezed or brought towards each other, the first claw member 4 and the second claw member 6 are brought apart further. FIG. 13*b* illustrates that when the first and second handles 8, 10 are brought apart further, the end wires of the torsion spring are brought closer towards each other.

From FIGS. 11*a*, 12*a* and 13*a*, it can be understood that path of movement of the protrusion 46 and the second projection 44 is determined by both the pivotal movement about the spring 30 and the pivotal movement about the pin. 26

Figure 14A:
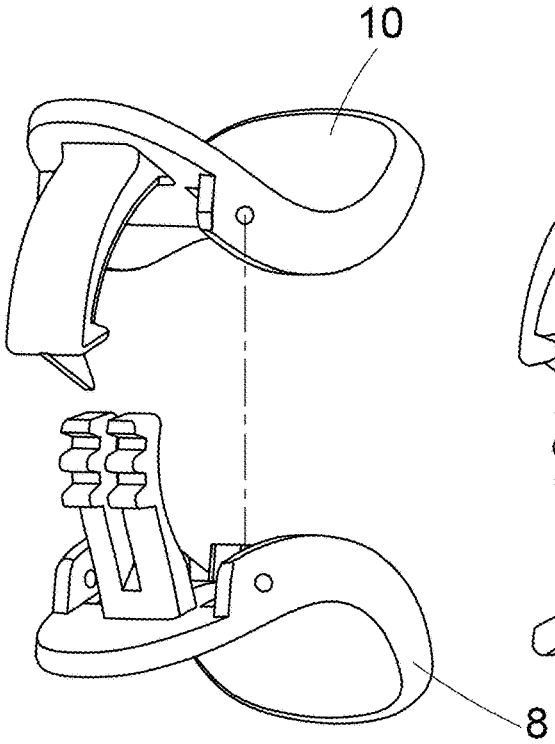
Figure 14B:
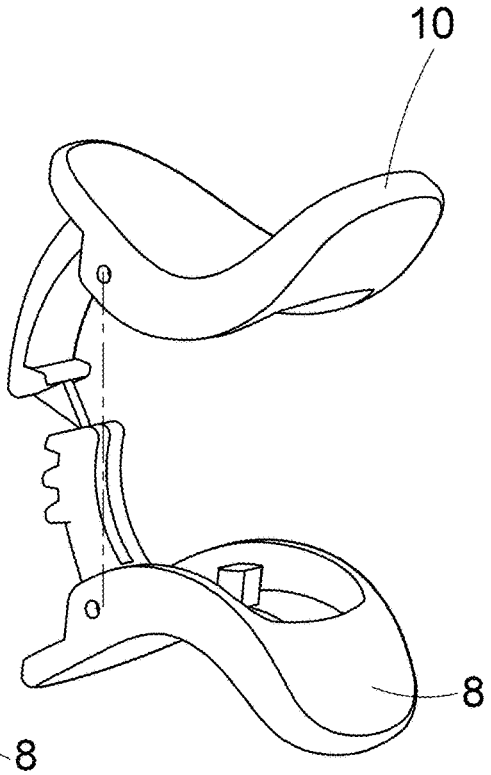
Figure 15:
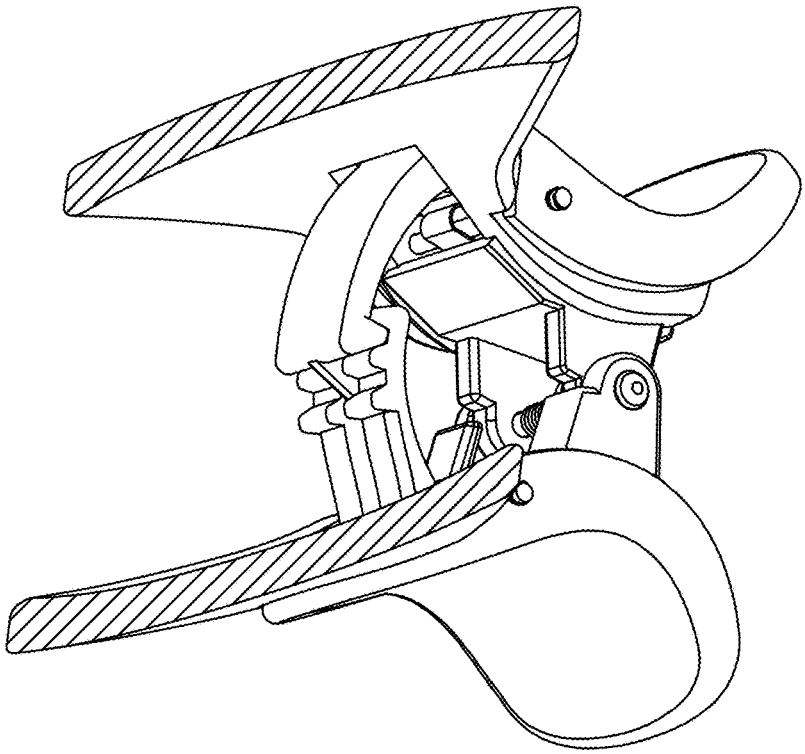
FIG. 15 is a schematic diagram of the hair fastener of FIG. 1 but with claw members thereof removed.

FIGS. 14*a* and 14*b* are enlarged schematic views showing the protrusion 46 and the three recesses 40*a*, 40*b*, 40*c* defined by the three rows of teeth 38*a*, 38*b*, 38*c*, respectively. FIG. 15 is an enlarged schematic view showing the protrusion 46 engaged in the first recess 40*a*.

Figure 16A:
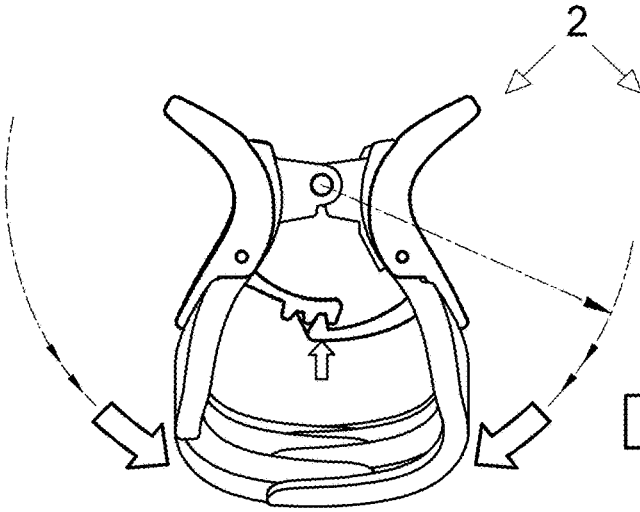
FIGS. 16*a* and 16*b* are schematic diagrams showing the hair fastener in a first locked configuration and a first but unlocked configuration, respectively.
Figure 16B:
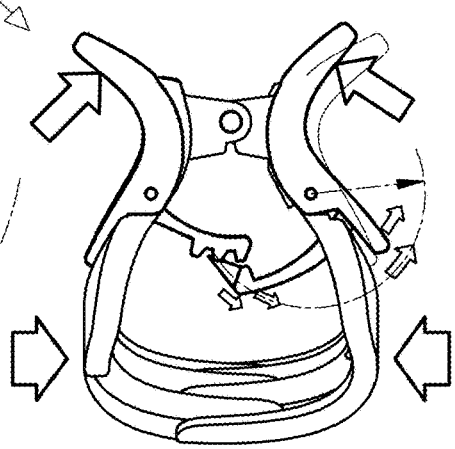

FIG. 16*a* illustrates a configuration in which the protrusion 46 engages in the first recess 40*a*. In this configuration, primarily due to the biasing force from the leaf spring 24 the protrusion 46 engages and locks against the legs 32 at the first recess 40*a*. Any attempted movement by the fastened hair between the first and second claw members 4, 6 would not move or otherwise disengage the protrusion 46 from the first recess 40*a*. In other words, the hair fastener 2 is locked in a first disposition in which maximum room is provided between the first and second claw members 4, 6. In order to release hair from the configuration of FIG. 16*a*, a user depresses the handles 8, 10 at their proximal end, moving and dislodging the protrusion 46 from the first recess 40*a*. Once the protrusion 46 is released from the first recess 40*a*, further depression of the first and second handles 8, 10 expand the claw members 4, 6 for releasing hair positioned therebetween.

Figure 17A:
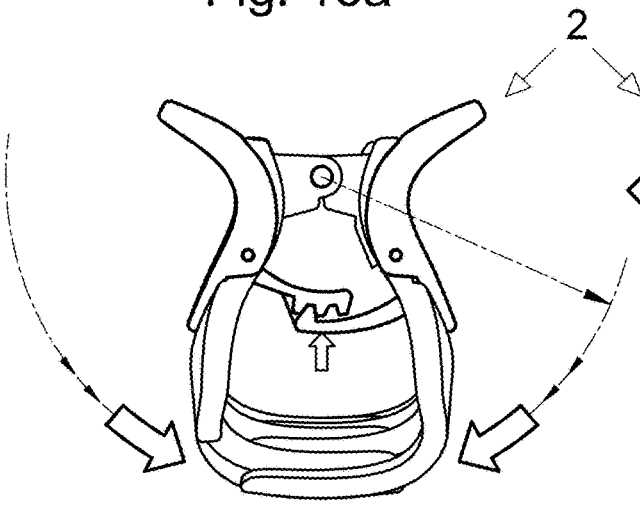
FIGS. 17*a* and 17*b* are schematic diagrams showing the hair fastener in a second locked configuration and a second but unlocked configuration, respectively.
Figure 17B:
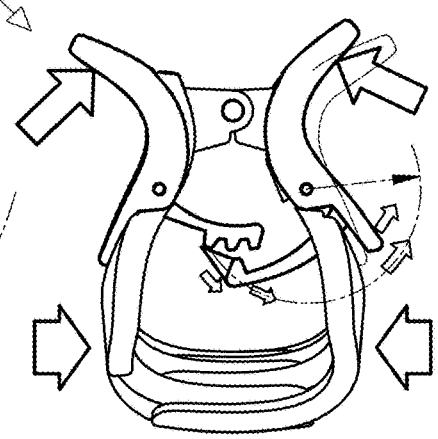

FIG. 17*a* illustrates another configuration in which the protrusion 46 engages in the second recess 40*b*. In this configuration, primarily due to the biasing force from the leaf spring 24 the protrusion 46 engages and locks against the legs 32 at the second recess 40*b*. Any attempted movement by the fastened hair between the first and second claw members 4, 6 would not move or otherwise disengage the protrusion 46 from the second recess 40*b*. In other words, the hair fastener 2 is locked in a second disposition in which medium room is provided between the first and second claw members 4, 6. In order to release hair from the configuration of FIG. 17*a*, a user depresses the handles 8, 10 at their proximal end, moving and dislodging the protrusion 46 from the second recess 40*b*. Once the protrusion 46 is released from the second recess 40*b*, further depression of the first and second handles 8, 10 expand the claw members 4, 6 for releasing hair positioned therebetween.

Figure 18A:
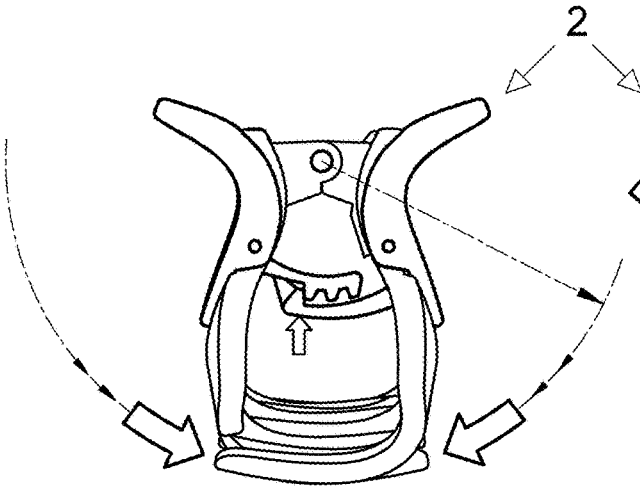
FIGS. 18*a* and 18*b* are schematic diagrams showing the hair fastener in a third locked configuration and a third but unlocked configuration, respectively.
Figure 18B:
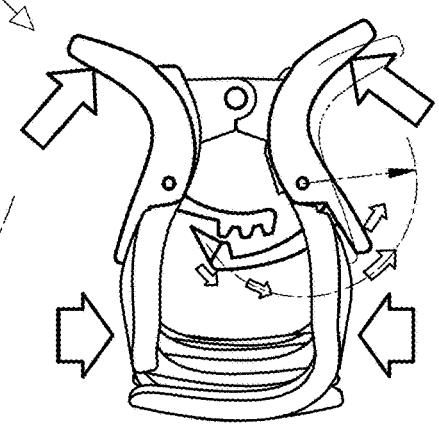
Figure 19:
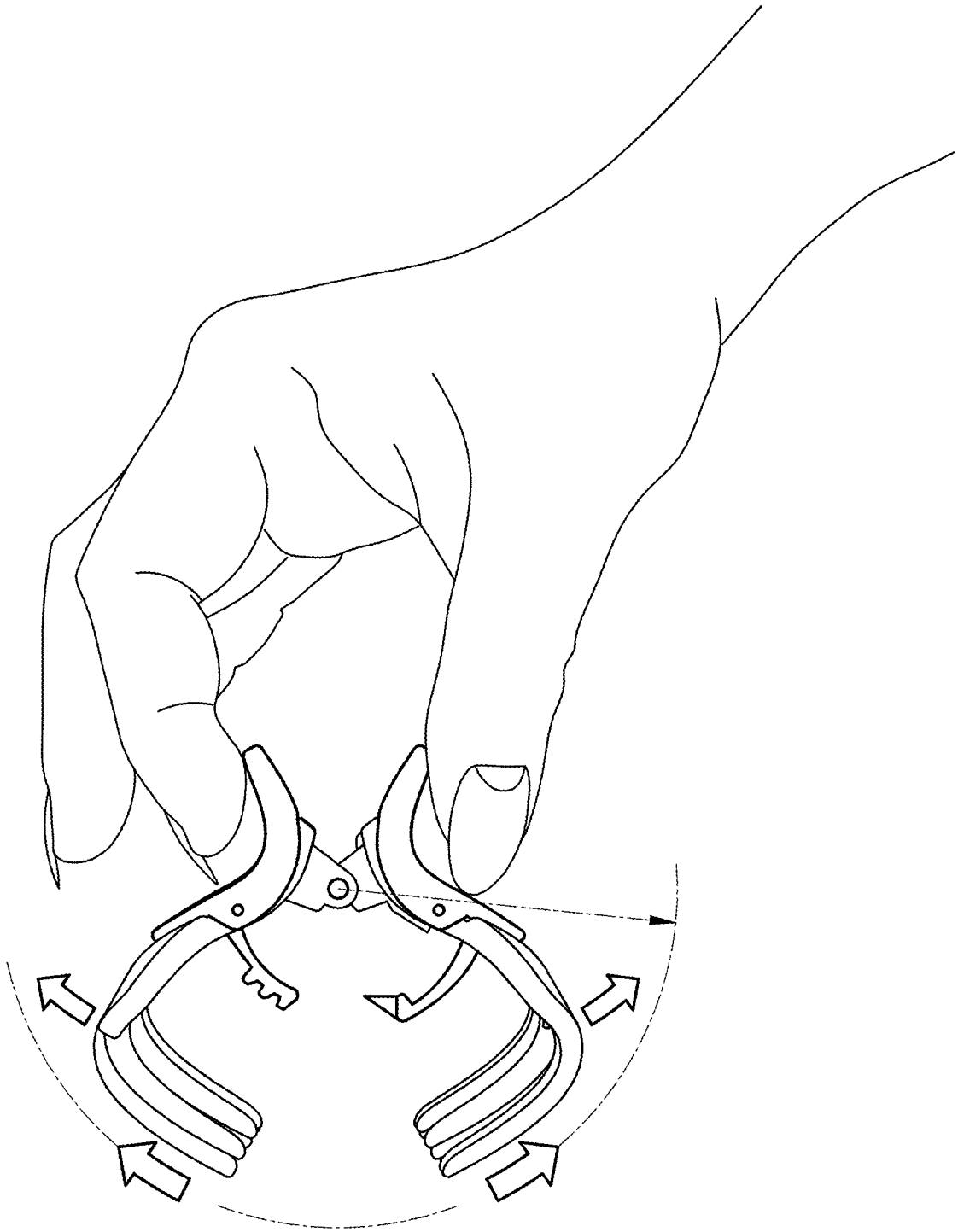
FIG. 19 is a schematic diagram showing the opening of the hair fastener of FIG. 1.

FIG. 18*a* illustrates another configuration in which the protrusion 46 engages in the third recess 40*c*. In this configuration, primarily due to the biasing force from the leaf spring 24 the protrusion 46 engages and locks against the legs at the third recess 40*c*. It is to be noted in the configuration, the first and second claw members are already at their closest extent and would not be able to move closer further. Any attempted movement by the tied hair between the first and second claw members 4, 6 would not move or otherwise disengage the protrusion 46 from the third recess 40*c*. In other words, the hair fastener 2 is locked in a third disposition in which minimal room is provided between the first and second claw members 4, 6. In order to release hair from the configuration of FIG. 18*a*, a user depresses the handles 8, 10 at their proximal end, moving and dislodging the protrusion 46 from the third recess 40*c*. Once the protrusion 46 is released from the third recess 40*c*, further depression of the first and second handles 8, 10 expand the claw members 4, 6 for releasing hair positioned therebetween. From the above illustration, it can thus be understood that the relative position and extent to which the first and second claw members 4. 6 are positioned and maintained is dependent on the particular recess at which the protrusion 46 engages and locks in.

FIG. 15 is a schematic view showing the opening of the first and second claw members of the hair fastener.

Embodiments of hair fastener according to the present invention are different and advantageous in a number of ways. One difference is that, with the provision of the locking mechanism, the first and second claw members would not be movable by unintended movement of tied hair positioned between the claw members. For instance, a user with his/her hair secured by the hair fastener can perform, for example, physical exercise, and this would not cause the first and second claw members to slip or change position relative to each other. Structurally, there is provided with a second hinge for providing pivotable connection of the second handle and the second claw member. This second hinge ensures the workability of the locking mechanism. With such a second hinge, the locking mechanism would only disengage when the user intentionally presses the handles together. Any unintentional movement of the hair would not release the first and second projections form each other.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. For example, while the first and second projections extend from the first and second handles, respectively, at about 90°, they need not extend at this particular inclination as long as they are engageable when the first and second claw members are closed. Further, while three recess are provided and thus the hair fastener can be locked in one of the three dispositions, fewer or more recesses may be provided. Yet further, while the first projection assumes the formation of two legs, only one leg, for example, would be needed as long the first and second projections are engageable and lockable against each other. Also, a skilled person in the art will be aware of the prior art which is not explained in the above for brevity purpose.

What is claimed is:

1. A hair fastener comprising:

a first hair claw member and a second hair claw member for accommodating and securing a lock of hair therebetween, a first hinge positioned between and pivotably connecting together rear ends of the first and second claw members for controlling relative movement thereof, wherein the first hinge includes a first pin defining a first axis about which the first and second claw members pivot, a first handle defining an inwardly facing surface and fixedly connected to the rear end of the first claw member the inwardly facing surface of the first handle abutting the rear end of the first claw member, a second handle defining an inwardly facing surface and pivotably connected to the rear end of the second claw member by a second pin defining a second axis with the inwardly facing surface of the second handle engaging the rear end of the second claw member, wherein the second handle is provided with a bay at the inwardly facing surface at which the rear end of the second claw member engages and to which the second claw member is pivotably connected, and wherein the inwardly facing surface of the second handle is convex such that a cavity is provided between the rear end of the second claw member and the inwardly facing surface of the second handle at the bay thus allowing pivotable movement of the second claw member with respect to the second handle member, a lock, including a first projection extending from a distal end of the inwardly facing surface of the first handle and a second projection extending from a distal end of the inwardly facing surface of the second handle in that the first and second projections are pointed towards and engageable with each other, the first projection defining a plurality of recesses along its length and the second projection defining a protrusion for engaging in one of the recesses, wherein:

the hair fastener is adapted to assume a first configuration in which the protrusion is engaged and locked in one of the recesses whereby fastened hair positioned between the first and second hair claw members does not move or expand the first and second claw members relative to each other, and a second configuration in which the protrusion, on depression of the second handle relative to the first handle, is disengaged from said one of the recesses of the first projection whereby the first and second claw members are movable away from each other thus releasing hair positioned therebetween, and the extent to which the first and second claw members are positioned and maintained with respect to each other is dependent on the particular recess at which the protrusion engages and locks in.

2. A hair fastener as claimed in claim 1, wherein each of the first and second claw members is provided with a plurality of fingers, and wherein, in the first configuration, the fingers of the first claw member and the fingers of the second claw members are arranged complementarily to each other or in an interlocking manner.

3. A hair fastener as claimed in claim 1, wherein the first hinge includes a torsional spring and the first pin defines a first axis about which the first and second claw members move relative to each other and for biasing the first and second claw members towards each other.

4. A hair fastener as claimed in claim 1, wherein the first handle is immovably connected to the rear end of the first claw member.

5. A hair fastener as claimed in claim 1, further comprising a second hinge in which the second pin resides for controlling pivotable movement of the second claw member and the second handle, wherein the second claw member is pivotably movable with respect the second handle about the second axis.

6. A hair fastener as claimed in claim 5, wherein the second hinge includes a leaf spring positioned in the cavity defined between the rear end of the second claw member and the second handle, and the second handle and the second claw member are sized and shaped to provide the cavity.

7. A hair fastener as claimed in claim 6, wherein, in the first configuration, the protrusion is biased by the leaf spring to engage and lock in said one of the recesses.

8. A hair fastener as claimed in claim 6, wherein, in the second configuration, initial depression of the second claw member actuates the second projection and thus moves the protrusion about the second axis and away from said one of the recesses against a biasing force from the leaf spring, and subsequent depression of the second handle moves the second claw member away from the first claw member about the first axis.

9. A hair fastener as claimed in claim 1, wherein:

the first projection is in the form of two legs arranged in parallel to each other and has a gap therebetween acting as a guide, the two legs are provided with a plurality of teeth along their length and the plurality of recesses are defined between the plurality of teeth, the second projection is in the form of a tongue provided with the protrusion at its distal end thereof, and the second projection is provided with a further peg receivable in the guide for aligning the second claw member with the first claw member.

10. A hair fastener comprising:

a first hair claw member and a second hair claw member for accommodating and securing a lock of hair therebetween and hingedly and pivotably movable about a first axis for controlling relative movement thereof, a first handle fixedly and immovably connected to the rear end of the first claw member such that movement of the first handle causes simultaneous movement of the first claw member, a second handle pivotably and movably connected to the rear end of the second claw member via a hinge such that the second handle and the second claw member are pivotably movable with respect to each other to some extent, a lock for locking the first handle and the second handle in a closed configuration when hair is secured therebetween including a first projection extending from the first handle and a second projection extending from the second handle in that the first and second projections are pointed towards and engageable with each other, the first projection defining a plurality of recesses along its length and the second projection defining a protrusion for engaging in one of the recesses, wherein:

the hair fastener is adapted to assume a first configuration in which the second hinge biases the protrusion axially towards one of the recesses, whereby the protrusion is engaged and locked in said one of the recesses and fastened hair positioned between the first and second hair claw members do not move the first and second claw members relative to each other.

11. A hair fastener as claimed in claim 10, wherein the hair fastener is adapted to assume a second configuration in which the protrusion of the second projection, on depression of the second handle relative to the first handle, is, against a biasing force from the second hinge, disengage from said one of the recesses of the first projection, whereby the first and second claw members are movable away from each other thus releasing hair positioned there between.

12. A hair fastener as claimed in claim 10, wherein each of the first and second claw members is provided with a plurality of fingers, and wherein, in the first configuration, the fingers of the first claw member and the fingers of the second claw members are arranged complementarily to each other or in an interlocking manner.

13. A hair fastener as claimed in claim 10, wherein the first hinge includes a torsional spring defining the first axis about which the first and second claw members move relative to each other and for biasing the first and second claw members towards each other.

14. A hair fastener as claimed in claim 10, wherein the first handle and the first claw member are integrally formed.

15. A hair fastener as claimed in claim 10, wherein the second hinge defines a second axis about which the second claw member and the second handle move relative to each other, and the second hinge includes a leaf spring positioned in a cavity between the rear end of the second claw member and the second handle.

16. A hair fastener as claimed in claim 15, wherein, in the first configuration, the protrusion is biased by the leaf spring to engage and lock in said one of the recesses.

17. A hair fastener as claimed in claim 15, wherein, in the second configuration, initial depression of the second handle actuates the second projection and thus the protrusion about the second axis and away from said one of the recesses thus unlocking the first and second claw members from each other, and subsequent depression of the second handle moves the second claw member away from the first claw member about the first axis.

18. A hair fastener as claimed in claim 11, wherein:

the first projection is the form of two legs arranged in parallel to each other and has a gap between the two legs acting as a guide, the two legs are provided with a plurality of teeth and the plurality of recesses are defined between the plurality of teeth, the second projection is in the form of a tongue provided with the protrusion at its distal end thereof, and the second projection is provided with a peg receivable in the guide for aligning the second claw member with the first claw member.

19. A hair fastener comprising:

a first hair claw member and a second hair claw member for accommodating and securing a lock of hair therebetween, a hinge positioned between and pivotably connecting rear ends of the first and second claw members together for controlling relative movement thereof, a first pin about which the first and second claw members pivot, a first handle immovably connected to a rear end of the first claw member, the first handle and the first claw member connected together such that the first handle and the first claw member do not pivot, and a second handle pivotably and movably connected to the rear end of the second claw member, a second pin about which the second handle and the second claw member pivots, the second handle is provided with a bay at an inwardly facing surface at which the rear end of the second claw member engages and to which the second claw member is pivotably connected, and wherein the inwardly facing surface is convex such that a cavity is provided between the rear end of the second claw member and the inwardly facing surface of the second handle at the bay thus allowing pivotable movement of the second claw member with respect to the second handle member, and a lock for locking the first handle and the second handle in a closed configuration when hair is secured therebetween including a first projection extending from the first handle and a second projection extending from the second handle in that the first and second projections are pointed towards, engageable with and lockable against each other.

20. A hair fastener as claimed in claim 19, wherein the first projection defines a plurality of recesses along its length and the second projection defines a protrusion for engaging in one of the recesses, wherein the extent to which the first and second claw members are positioned and maintained is dependent on the particular recess at which the protrusion engages and locks in.

* * * * *